United States Patent [19]

Chodil

[11] 3,999,094

[45] Dec. 21, 1976

[54] CATHODOLUMINESCENT GAS DISCHARGE DEVICE WITH IMPROVED MODULATION CHARACTERISTICS

[75] Inventor: Gerald Joseph Chodil, Highland Park, Ill.

[73] Assignee: Zenith Radio Corporation, Chicago, Ill.

[22] Filed: June 27, 1975

[21] Appl. No.: 591,192

[52] U.S. Cl. ..... 313/192; 313/231; 315/111; 313/183

[51] Int. Cl.[2] ..... H01J 17/04

[58] Field of Search ..... 313/177, 178, 191, 209, 313/207, 210, 183–188, 192, 193, 194, 294, 296, 297, 298, 303, 306; 315/111

[56] References Cited

UNITED STATES PATENTS

| | | | |
|---|---|---|---|
| 2,288,256 | 6/1942 | Shepherd | 250/37 |
| 2,495,908 | 1/1950 | Rich | 250/27.5 |
| 2,857,542 | 10/1958 | Curtis | 313/199 |
| 3,324,348 | 6/1967 | Baker | 315/168 |
| 3,409,793 | 11/1968 | Stutsman | 313/193 |
| 3,831,052 | 8/1974 | Knechtli | 313/187 |
| 3,882,342 | 6/1975 | Kamegaya et al. | 313/188 |
| 3,909,652 | 9/1975 | Ferre et al. | 313/146 |

*Primary Examiner*—R. V. Rolinec
*Assistant Examiner*—Vincent J. Sunderdick
*Attorney, Agent, or Firm*—John H. Coult

[57] ABSTRACT

A cathodoluminescent gas discharge device having improved modulation characteristics whereby an electron beam generated by the device is more easily modulated by a small control voltage. The improved gas discharge device includes a cathode for generating a gas discharge to be used as a source of electrons. An electron-transmissive extraction grid is spaced from the cathode and receives an electrical potential for extracting electrons from the gas discharge. An electron-transmissive modulation grid is spaced from the extraction grid and receives a control voltage for modulating the flow of electrons through itself. A "drift space" having a length approximately equivalent to at least one ionization mean free path is located between either the extraction grid and the cathode electrode or between the extraction grid and the modulation grid in order to lower the energy of the electrons arriving at the modulation grid so that the flow of electrons therethrough can be modulated by a smaller amplitude control voltage than is possible without the drift space. A target anode is spaced from the modulation grid and receives an accelerating potential for accelerating toward itself those electrons which pass through the modulation grid. The spacing between the target anode and the modulation grid is chosen to be too small, at the gas pressure within the device, to sustain a gas discharge therebetween.

11 Claims, 9 Drawing Figures

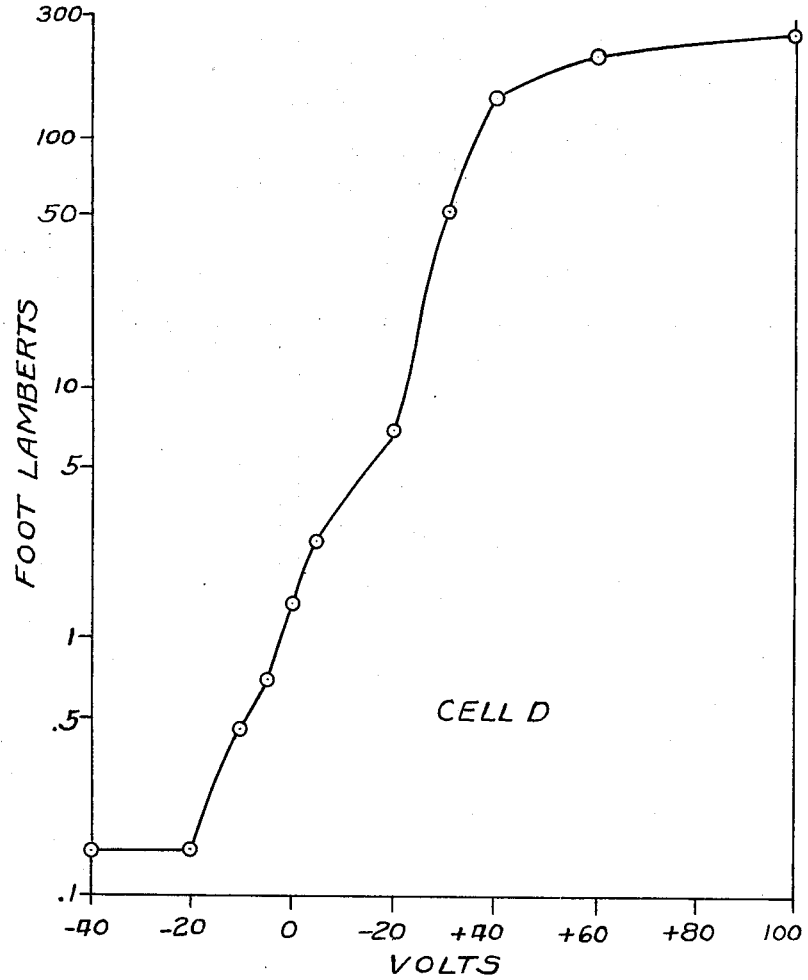
Fig. 6.
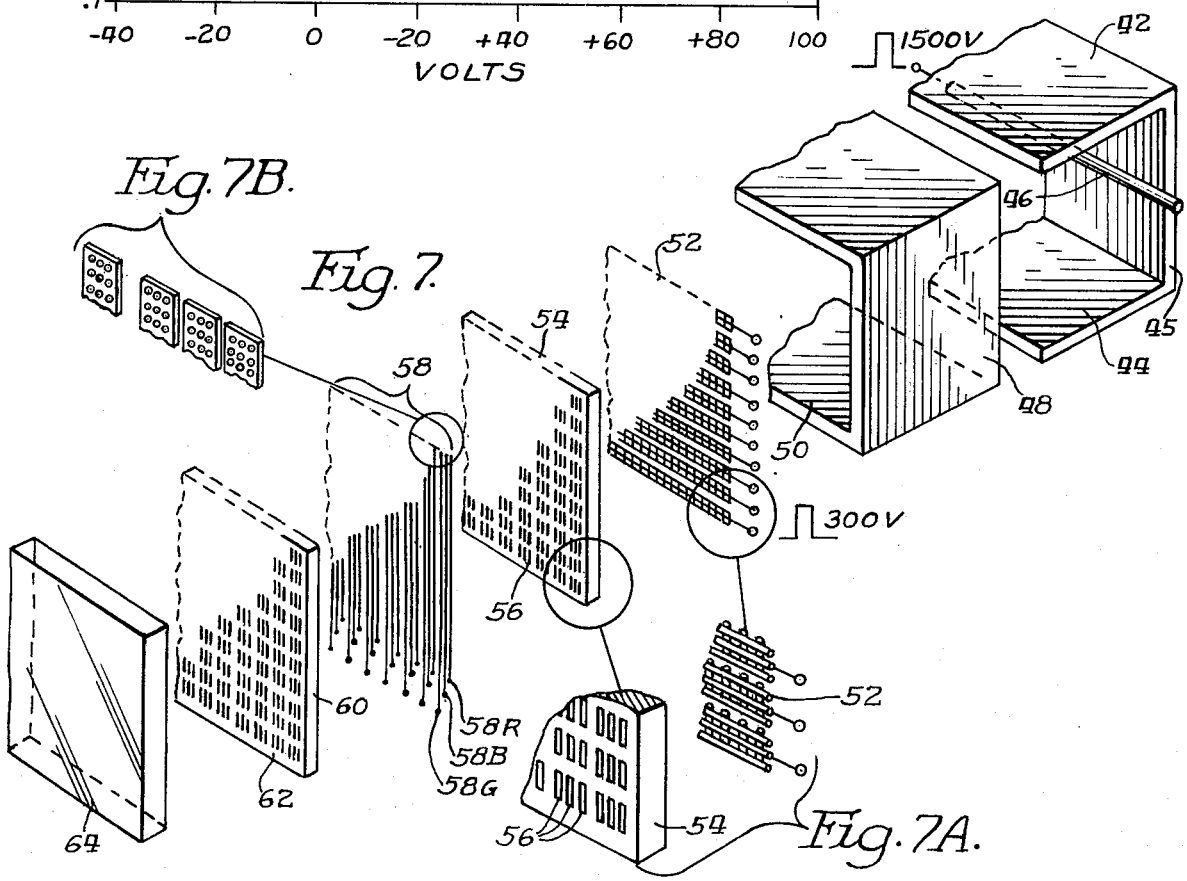
Fig. 7B.
Fig. 7.
Fig. 7A.

CATHODOLUMINESCENT GAS DISCHARGE DEVICE WITH IMPROVED MODULATION CHARACTERISTICS

CROSS-REFERENCE TO RELATED APPLICATION

This application is related to, but not dependent upon, co-pending application Ser. No. 588,737, filed June 20, 1975, assigned to the assignee of this application.

BACKGROUND OF THE INVENTION

This invention relates generally to gas discharge systems and, in particular, to cathodoluminescent systems wherein a gas discharge is used as an electron source from which electrons are extracted for acceleration toward a designated target.

In many cases where electrons are extracted from a gas discharge for use in bombarding a target, the electron beam so formed is modulated by a control voltage prior to being accelerated toward the final target. Such modulation may be effected by interposing an electron-transmissive control grid between the extracted electrons and the target. By varying the voltage on the control grid, the number of electrons which pass through it can be varied.

A problem with such prior art gas discharge systems is the large control voltage change which is required to effectively modulate the electron beam. In some applications, particularly those where the control voltage need not be varied rapidly, the requirement of a large control voltage is not a serious disadvantage. However, when such a system must respond to a rapidly varying control signal, a great deal of reactive power must necessarily be expended to drive the control grid.

The use of large amplitude control signals is particularly disadvantageous in gas discharge display systems where many control grids are used, such as in systems producing television images. In such cases, it becomes uneconomical to use anything but integrated circuit technology for building the control grid drivers. If large amplitude control signals (300–400 volts) are needed, the integrated circuit drivers become either impossible to manufacture or prohibitively expensive.

Another problem which exists when the above described type of cathodoluminescent system is used in a gas discharge display is that the resultant contrast ratio is somewhat small. Thus, even though large amplitude control signals must be used with the prior art systems, the degree to which even they can control the electron beam remains smaller than is desirable.

OBJECTS OF THE INVENTION

It is a general object of this invention to provide a gas discharge device for developing one or more electron beams which are more easily modulated than electron beams of prior art gas discharge devices.

It is another object of this invention to provide such an improvement in the modulation characteristics of gas discharge devices without the use of additional electrodes.

It is yet another object of this invention to provide a cathodoluminescent gas discharge device capable of generating visual images and capable of modulating the images with the use of much lower modulating voltages that heretofore possible.

It is another object of this invention to provide a cathodoluminescent gas discharge display which exhibits a large contrast ratio when modulated by a much smaller modulating voltage than normally required by prior art displays.

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawings, in the several figures of which like reference numerals identify like elements, and in which:

FIG. 6 is a plot of data illustrating the operation of the FIG. 5 device;

FIG. 7 is an exploded view of an exemplary cathodoluminescent gas discharge display system according to this invention; and FIGS. 7A and 7B are expanded views of elements of the FIG. 7 embodiment.

DESCRIPTION OF THE PREFERRED EMBODIMENT

Figure 1:
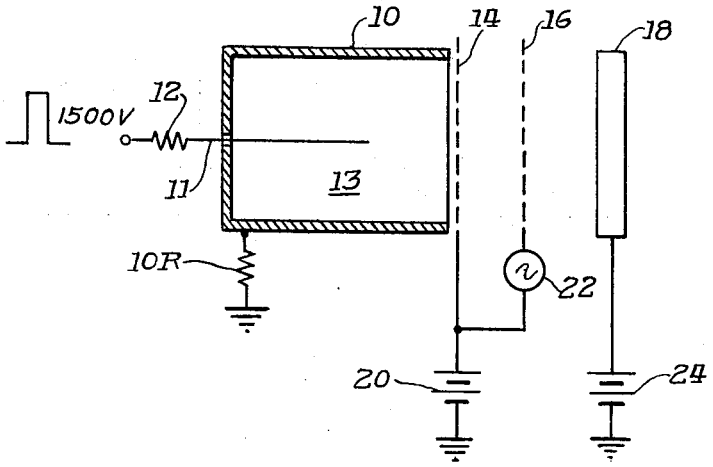
Fig. 1. PRIOR ART
FIG. 1 is a schematic cross-sectional view of a prior art gas discharge device.

As has been pointed out above, this invention is particularly related to gas discharge devices wherein a gas discharge is generated and used as a source of electrons. The electrons are extracted from the discharge and accelerated toward a target such as an accelerating anode. An electron-transmissive control grid is generally situated between the target and the electron source for controlling the number of electrons which pass through it and which then continue on to strike the target.

An example of such a device is shown in U.S. Pat. No. 3,831,052. A gas discharge device which is similar to that shown in the above-identified patent is illustrated in schematic cross section in FIG. 1. As shown therein, the gas discharge device includes a hollow cathode 10 which is grounded through a current-limiting resistor 10R, an igniter wire 11 which is in series with a current-limiting resistor 12 and which protrudes into the cavity 13 enclosed by a cathode 10, a first electron-transmissive grid 14 which is substantially flush with the opening in hollow cathode 10, a second electron-transmissive grid 16, and a target anode 18.

In operation, the elements shown in FIG. 1 are enclosed in an atmosphere of an ionizable gas such as helium and a gas discharge is initiated in the volume enclosed by cathode 10 by applying an igniter pulse of approximately 1500 volts to igniter wire 12. With grid 14 coupled to a source 20 of DC voltage of 500V volts, for example, the discharge ignited by igniter wire 12 is continued and spreads throughout the volume partially enclosed by cathode 10.

Grid 14, being electron-transmissive, extracts electrons present in the discharge and permits them to propagate forward toward grid 16.

Grid 16 is a modulating grid which receives a control voltage from source 22 for controlling the flow of electrons through itself. As shown, source 22 is serially connected between DC source 20 and grid 16. The flow of electrons from cathode 10 and through grids 14 and 16 is modulated in accordance with the signal supplied by source 22.

The electrons which pass through grid 16 are accelerated toward target anode 18 by an electric field which is created between grid 16 and target anode 18 by a high voltage of approximately 10,000 volts supplied by source 24. The spacings between grid 16 and target anode 18 and between grids 14 and 16 are usually selected to be too small, at the gas pressure within the system, to sustain a gas discharge therebetween: that is, in the space between electrodes 14, 16 and 18 the operation of the device is to the left of the standard Paschen curve for the gas used. Thus, from a gas discharge generated in cavity 13, electrons are extracted and accelerated to hit a designated target which occupies a position where no discharge is present.

An example of an application of the FIG. 1 combination is an image display system wherein an electron beam which is extracted by grid 14 and modulated by grid 16 is used to excite a phosphor coating on the inner surface of target anode 18. If anode 18 is transparent and if source 22 supplies an information signal, that information can be "written" on anode 18 and viewed by a viewer.

There is, however, a disadvantage inherent in the FIG. 1 combination, particularly when the modulating voltage applied to modulation grid 16 varies rapidly; namely, that in order to modulate the electron beam such that the number of electrons which pass through grid 16 is varied by two orders of magnitude, a modulating voltage of approximately 200 volts is required. For cases where the modulating voltage is a rapidly varying signal such as a television signal, it would require a substantial amount of reactive power to modulate the electron beam sufficiently to generate a suitable contrast ratio for the image "written" on anode 18.

Figure 2:
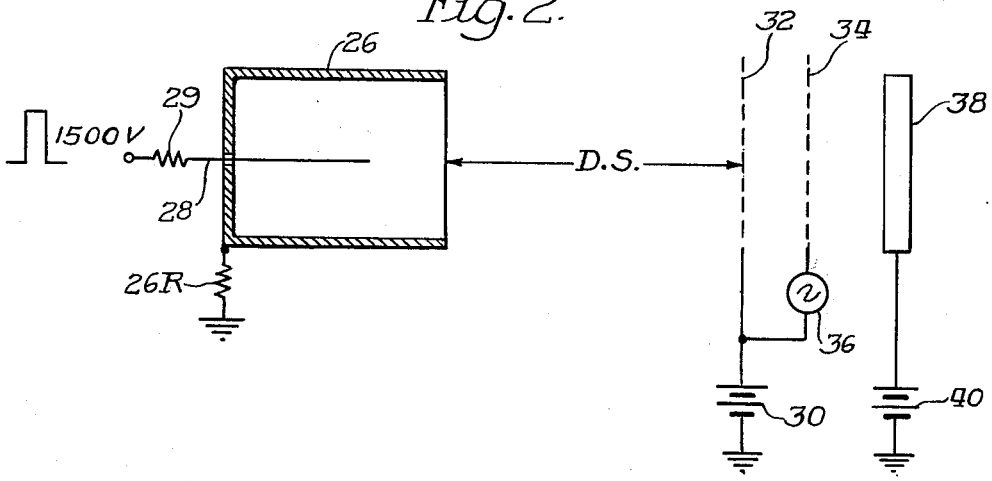
FIG. 2 is a schematic cross-sectional view of a gas discharge device according to the invention.

According to this invention, the undesirable requirement of a high level modulating signal for effectively modulating the electron beam of the FIG. 1 embodiment has been greatly moderated and a greater contrast ratio has been obtained by effectively reducing the energy level of the electrons which grid 16 must control. FIG. 2 illustrates how the FIG. 1 prior art structure has been modified according to this invention to provide low energy electrons for modulation by a low level modulation signal. This improvement is effected without the use of any additional electrodes over those shown in FIG. 1, but by a novel selective positioning of grids and selection of gas pressure, as will be described below.

Referring now to FIG. 2, there is shown an embodiment of this invention which includes the same elements shown in FIG. 1, but selectively repositioned according to this invention. As with the FIG. 1 embodiment, a hollow cathode discharge is generated within a hollow cathode 26 which may be grounded through a current-limiting resistor 26R. The discharge is initiated by the application of an igniter pulse of 1500 volts to igniter wire 28 through current-limiting resistor 29. The hollow cathode discharge within the volume partially enclosed by hollow cathode 26 is sustained by a DC voltage of 500 volts supplied by source 30 coupled to extractor grid 32. However, rather than extractor grid 32 being substantially flush with hollow cathode 26 as is the case with the FIG. 1 prior art structure, grid 32 is spaced from cathode 26 by a "drift space" labeled "DS" in FIG. 2. The purpose of the drift space is to provide a region where the high energy electrons which are within the gas discharge partially enclosed by hollow cathode 26 can make inelastic collisions while traversing the drift space and thereby lose a significant fraction of their kinetic energy before arriving at extraction grid 32. The length of the drift space required to substantially reduce the kinetic energy of the electrons depends upon the geometry of the structure, the gas, and the pressure of the gas in the system, but, in general, it can be stated that the drift space should have a length which is approximately equivalent to at least one ionization mean free path. (An ionization mean free path is used herein to mean the average distance travelled by an electron between ionizing collisions). In the case of a system operating in an atmosphere of helium at a pressure of 300 millitorr, for example, the minimum ionization mean free path is approximately 3.3 centimeters.

Although a drift space having a length of approximately 1 ionization mean free path may not be the ideal length for a given application, it appears to be near the minimum length which can usefully decrease the energy of the electrons which reach extraction grid 32. As will be pointed out below in more detail, a number of experiments were conducted to determine the best length for the drift space and to investigate and understand the behavior of the discharge which occupies the drift space. In that investigation, it was observed that in helium systems having a drift space of a useful length, a positive column effect was observed in the drift space area. Thus, the criteria for setting a minimum useful length for a drift space can also be stated in terms of length necessary to generate a positive column; namely, that the spacing between cathode 26 and extraction grid 32 should be selected such that a positive column is generated between cathode 26 and extraction grid 32.

Referring again to FIG. 2, extraction grid 32 is followed by an electron-transmissive modulation grid 34 which receives a modulating or control signal from source 36 for controlling the flow of electrons through grid 34. Source 36 is serially coupled between DC source 30 and grid 34.

A target anode 38 receives an accelerating potential from source 40 for generating an electric field in the space between grid 34 and anode 38 so as to accelerate the electrons which pass through grid 34 for impingement upon anode 38. The spacings between grid 34 and target anode 38 and between grids 32 and 34 are selected for operation to the left of the Paschen curve.

In order to effectively compare the benefits obtainable by including a drift space in a gas discharge cell as shown in FIG. 2, two gas discharge cells were constructed, one according to FIG. 1 and another according to FIG. 2. The cells were substantially identical except for the inclusion of one cell in a drift space between the hollow cathode and the extraction grid. Each cell had a cylindrical hollow cathode having a length of approximately 1½ inches and a diameter of approximately ¾ inches. In each case the extraction grid was made of 325 mesh stainless steel screen. In the cell without the drift space, the extraction grid was substantially flush with the hollow cathode as shown in FIG. 1. In the cell with the drift space, the extraction grid was spaced from the hollow cathode by a distance of approximately 3 inches. In both cells a modulation grid followed the extraction grid and was spaced therefrom by 0.050 inches. Both modulation grids were made from 325 mesh stainless steel screen. The target anodes of each cell were made of transparent glass plate with a transparent tin oxide coating thereon for receiving the high voltage accelerating potential. Both cells were operated in an environment of helium at a pressure of 300 millitorr. The spacing between target anode and modulation grid was 0.20 inches for both cells. A $Zn_2SiO_4$:Mn phosphor coating of 3mg/cm$^2$ was applied over the inner surface of each target anode so as to generate a visible light output upon impingement of a target anode by electrons.

In order to facilitate the discussion to follow, the cell built without a drift space, corresponding to the FIG. 1 structure, will be referred to as Cell A. The cell built with a drift space, corresponding to the FIG. 2 structure, will be referred to as Cell B. Each cell had a potential of 6000 volts applied to its target anode. The potential applied to each extractor grid was 400 volts, pulsed for a duration of 60 microseconds every 33 milliseconds in order to simulate a cell operating in a line-at-a-time mode and at U.S. television scan rates.

Figure 3:
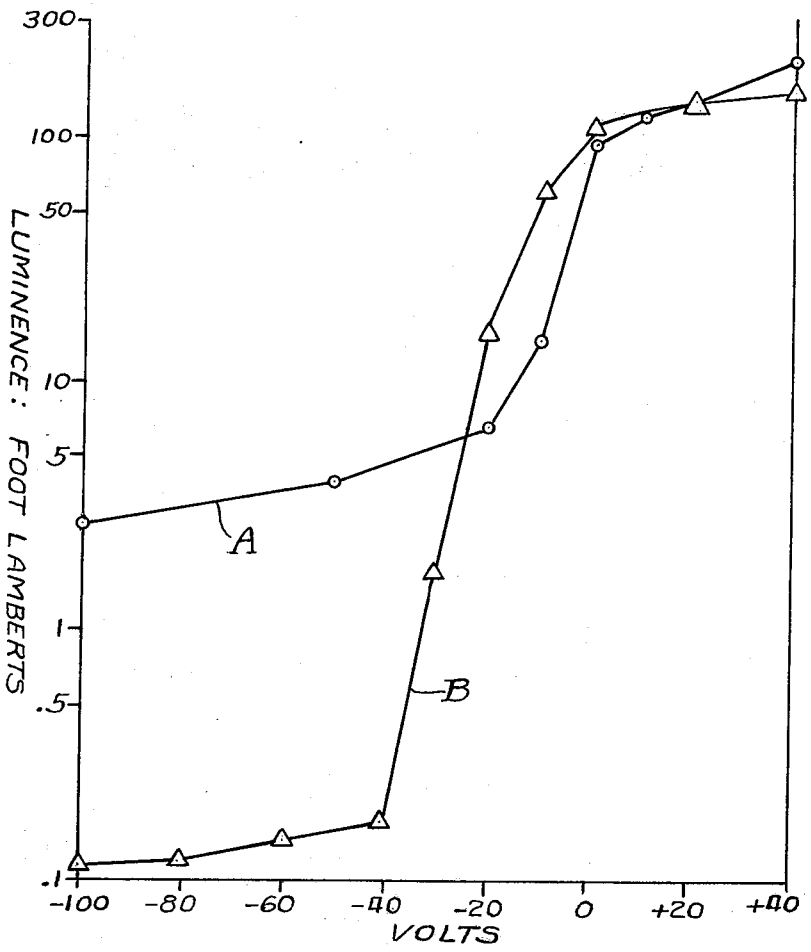

Referring now to FIG. 3, there is shown a graph having two curves, A and B, which illustrates the comparative operation of cells A and B respectively. Specifically, the graphs shown in FIG. 3 depict the measured light output of cells A and B vs. the control voltage which was applied between their extraction grids and their modulation grids. The abscissa of FIG. 3 is calibrated in volts applied between their respective modulation grids and the ordinate of FIG. 3 is a logarithmic scale on which is plotted luminance output in foot lamberts.

As FIG. 3 clearly shows, cell B's luminance output can be varied over a range of from approximately 0.17 foot lamberts to 115 foot lamberts by varying the voltage on its modulation grid from minus 40 volts to 0 volts. This translates to a contrast ratio of approximately 675. Cell A on the other hand was unable to generate the contrast ratio of cell B under any circumstances. For cell A, a contrast ratio of only 20 was obtained for the identical voltage change on its modulation grid (all plotted data have been corrected for the contribution to luminance due to fact igniter pulse). This outstanding improvement in the ability to modulate the current of cell B is directly attributable to the fact that the maximum kinetic energy of the electrons available at the extraction grid of cell B is reduced from approximately 300 or 400 electron volts (for the FIG. 1 structure) to something less than approximately 40 electron volts (for the structure of FIG. 2), all by virtue of the fact that a drift space was included between the cathode and extraction grid of cell B.

In order to more clearly understand and predict the behavior of cells having a drift space, a third cell, referred to hereinafter as cell C, was built having a drift space of ¾ of an inch between it cathode and its extraction grid. Cell C was substantially identical in all respects to cells A and B except for the fact that it had the above-mentioned drift space of ¾ of an inch and had provisions for varying the pressure of helium within the cell in order to determine what effect the pressure of variation would cause.

Figure 4:
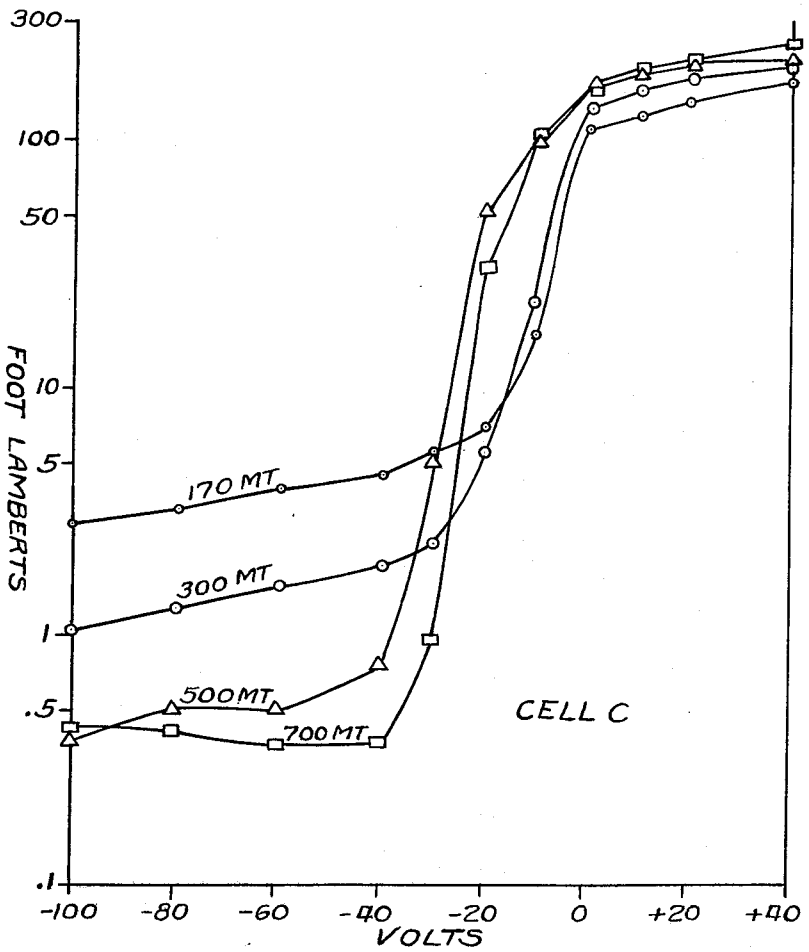
FIGS. 3 and 4 are plots of data which are helpful in explaining the operation of this invention.

Referring now to FIG. 4, there is shown a plot of data taken on cell C at 170 millitorr of helium, 300 millitorr of helium, 500 millitorr of helium, and 700 millitorr of helium. The abscissa and ordinate of FIG. 4 are identical to the abscissa and ordinate of FIG. 3.

Referring first to the plotted set of data labelled 170mt (millitorr) in FIG. 4, one notices that that particular curve is nearly identical to curve A of FIG. 3, even though cell C has a drift space of ¾ inch and cell A has no drift space. It is evident, therefore, that the effectiveness of the drift space is dependent not only upon the physical distance separating the cathode and the extraction grid, but also the pressure of the gas in the drift space. More specifically, the drift space effectiveness is a function of P×D, where P is the pressure of a gas in the drift space and D is the lengthwise dimension of the drift space.

Referring back to FIG. 4 again, there is an obvious increase in the ability of the cell to be modulated as the pressure is increased. The 500mt shows a substantial increase in the effectiveness of the drift space over the 300 millitorr data, but increasing the gas pressure to 700 millitorr does not appear to result in a correspondingly greater effectiveness of the drift space. The conclusion which is drawn from the FIG. 4 data, therefore, is that for a cell having a ¾ inch drift space between its cathode and its extraction grid, a pressure of helium of approximately 500 millitorr will result in a very effective cell. More generally, the drift space should have a length D such that the product in the drift space is equivalent to approximately 1.0 torr-centimeter of helium (500 millitorr × ¾ inch equals 0.95 torr-centimeter). Obviously, any increases in the P×D product above 0.32 torr-centimeters of helium (170 millitorr × ¾ inch equals 0.32 torr-centimeter will result in improved operation but the point at which maximum usefullness appears to be obtainable is in the area of approximately 1 torr-centimeter of helium.

In cases where gases other than helium are used, the proper P×D relationship for the drift space can be determined experimentally. For example, it has been determined that, for neon, a P×D product of 0.4 torr-centimeters produces a drift space which is equivalent to approximately 1 torr-centimeter of helium. For argon, it was found that a P×D product of 0.1 torr-centimeter in the drift space is equivalent to a 1 torr-centimeter drift space of helium. These numbers for helium, neon, and argon correspond to the tabulated minimum ionization mean free paths for the gases. See, for example, *Electronic and Ionic Impact Phenomena*, by Massey and Burhop, Oxford Press, 1956 for such a tabulation.

Once the required P×D drift space relationship has been determined for a particular gas, the approximate minimum spacing between the modulation grid (grid 34 in FIG. 2) and the target anode (anode 38 in FIG. 2) to ensure that no discharge can exist therebetween (i.e., operation is to the left of the Paschen curve) can be determined by dividing the minimum drift space length by 4. This calculation is effective for an accelerating potential of approximately 6KV on the target anode. For higher accelerating potentials, the spacing between modulation grid and target anode must be reduced somewhat further.

Figure 5:
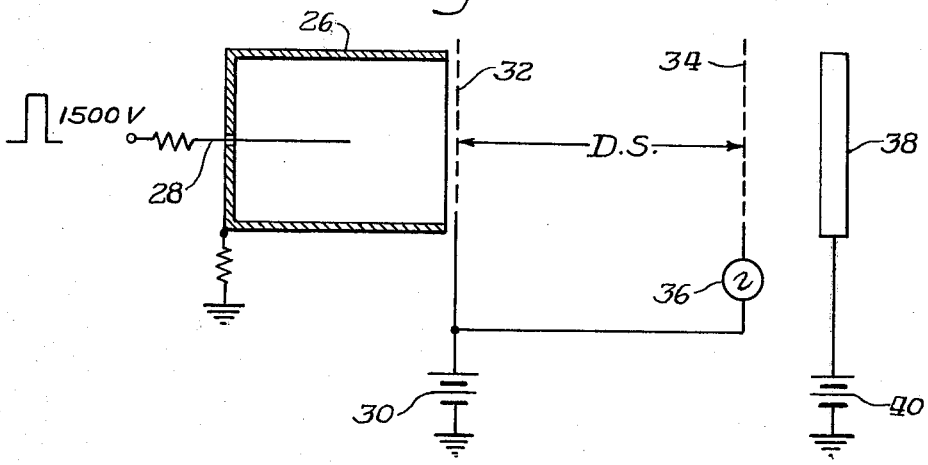
FIG. 5 is a schematic cross-sectional view of another gas discharge device according to the invention.

Up to this point, this invention has been described in connection with a gas discharge cell having a drift space located between a cathode and an extraction grid as shown in FIG. 2. However, this invention is not so limited. The drift space may alternately be located between an extraction grid and a modulation grid, as shown in FIG. 5. Like-numbered elements of FIG. 2 and FIG. 5 are identical except for the locations of extractor grid 32 and modulating grid 34. As shown in FIG. 5, extractor grid 32 is substantially flush with the opening in cathode 26. A drift space separates extraction grid 32 and modulation grid 34. In other respects, the structures of FIG. 2 and FIG. 5 are identical.

Locating the drift space between extraction grid 32 and modulating grid 34 has an effect on the ability of the cell to be modulated which is very similar to the effect gained by locating the drift space between the cathode and the extraction grid as shown in FIG. 2. A fourth cell, cell D, was built according to the FIG. 5 structure with the drift space located between the extraction grid and the modulating grid. The cell was filled with helium at 300 millitorr and the drift space was set at 3 inches. The operation of cell D is shown in FIG. 6 which is a data plot of its luminance light output vs. modulating grid voltage. The testing was done under the same conditions and was similar to the electrode potentials as used in cells, A, B, and C. As shown in FIG. 6, for a change in the modulating voltage from zero volts to +40 volts, the luminance output changes from 1.4 foot lambert to 150 foot lamberts, a contrast ratio of approximately 107. This compares extremely favorably with the contrast ratio of 20 provided by cell A which was also operated at 300 millitorr but without a drift space.

The one possibly undesirable aspect of the operation of cell D is the non-linear characteristic of the data curve which exists, particularly between modulating voltages of +5 volts and +30 volts. Although this non-linearity may be relatively unimportant for some applications, other applications may find the relatively linear curve associated with cell B (FIG. 3) more useful.

As has been pointed out above, this invention is especially useful for applications in which a gas discharge device is used in a video display system for displaying television images. In such systems, generally, many modulating grid drivers are necessary, and applying large amplitude modulating voltages to the modulating grids is most undesirable from the standpoints of efficiency and practicality.

An exemplary flat panel gas discharge display system in which this invention finds use is shown in FIG. 7. The schematic exploded view shown in FIG. 7 is of a structure which is designed for a three-color, line-at-a-time gas discharge display operating in an environment of Helium at a pressure of 400 millitorr. A structure which is similar to the FIG. 7 structure but which has no drift space is discussed and claimed in a copending application, Ser. No. 588,737, filed June 20, 1975, and assigned to the assignee of this invention. The FIG. 7 view depicts the electrodes which are required to generate ten rows or lines and eight columns of a video display in a flat panel gas discharge display system. However, the structure shown can easily be modified to include as many rows and columns as are necessary for a particular application. For television applications, approximately 481 rows and approximately 1500 columns are required. Also, the size of some elements has been exaggerated for clarity.

Beginning at the rear of the FIG. 7 panel, there is a cathode structure which includes upper and lower cathode plates 42 and 44 connected by a rear plate 45. Plates 42 and 44 are substantially parallel to each other, extend row-wise across the panel and are spaced apart by a distance equivalent to ten rows of picture elements. (A picture element is defined herein as the smallest discrete excited light emitting unit on a panel faceplate. In a system which has triads of red, blue and green phosphor deposits on a viewable faceplate, a picture element is one triad wide and has a height equal to the height of the viewable faceplate area divided by the number of scanned rows).

Plates 42 and 44 together act to partially enclose a volume of gas between them within which a hollow cathode discharge is established.

An igniter wire 46 extends into the volume which is partially enclosed by plates 42 and 44 and may extend across the entire width of the panel. A potential of approximately 1500 volts is applied to igniter wire 46 for initiating a discharge between itself and the cathode structure.

Although only one set of cathode plates is shown, it is understood that the structure including plates 42 and 44 can be duplicated for as many cathode rows as are necessary to complete the required embodiment.

Immediately forward of plates 42 and 44 is a dielectric spacer 48 which is approximately 1 inch thick. Spacer 48 has one large aperture 50 in which a drift space of approximately 1 inch exists. With a one inch thickness for spacer 48 and a gas pressure of 400 millitorr, the drift space is operating at approximately one torr-centimeter of Helium.

Forward of spacer 48 is an array of electron-transmissive grids 52, each of which extends row-wise across the panel. Grids 52 successively receive a 300 volt scanning potential which causes the panel to scan from top to bottom. Preferably, approximately each tenth grid 52 is electrically connected and receives the same scanning potential. This means that a ten phase driver is needed for scanning the panel from top to bottom. (A 10 phase driver is an electrical circuit capable of applying scanning potentials to successive grids. Every 10th grid is connected to one phase of the driver; for example, the first, the eleventh, the twenty-first, etc., grids are tied together and tied to phase one of the driver. The other grids are similarly connected to their respective phases of the driver.) For television applications, the scan potential is applied to each grid 52 for approximately 63 microseconds.

Forward of grids 52 is another spacer 54 having an array of apertures 56. Spacer 54 is approximately 250 mils thick for the particular embodiment shown but, in any event, is not so thick as to permit a gas discharge to exist forward of grids 52 at the particular pressure used in the panel.

Apertures 56 are shown as rectangular and have widths which are approximately equal to the width of one phosphor deposit on the faceplate. All apertures 56 in a row of apertures are aligned with one grid 52. This relationship is more clearly shown in FIG. 7A.

Forward of spacer 54 is an array of modulation grids 58 which receive video signals for modulating the streams of electrons. Grids 58 comprise repeating sets of grids 58R, 58B, 58G, with the red components of the video signals being applied to grids 58R, the blue components to grids 58B, and the green components to grids 58G. There is one grid 58 in alignment with each aperture 56 in spacer 54. FIG. 7B shows an expanded view of grids 58.

In line-at-a-time operation each picture element in a row of picture elements is illuminated simultaneously. Therefore, the various grids 58 may not be tied together, but must receive independent video signals for simultaneously energizing each picture element.

Forward of grids 58 is another di-electric spacer 60 having an array of apertures 62. Apertures 62 are identical to and aligned with apertures 56 in spacer 54. The thickness of spacer 62 is identical to the thickness of spacer 54. Thus, no gas discharge can exist in the area forward of the grids 58.

The final element of this structure is a glass faceplate 64 on which are deposited on its inside surface stripes of red, blue, and green phosphors (not shown) which are aligned with apertures 62 and grids 58.

The operation of the FIG. 7 structure may be briefly summarized as follows. A rich source of electrons is generated in a gas discharge which exists in the volume partially enclosed by cathode plates 42 and 44. The potential on grids 52 extracts electrons from the gas discharge by drawing them through the drift space which exists between cathode plates 42, 44 and grids 52. The extracted electrons pass through grids 52 and apertures 56, and modulated by the signals on grids 58, and are accelerated forward to impinge on and excite phosphor deposits on faceplate 64. Row selection is accomplished by successively energizing grids 52 while each picture element in a row is simultaneously energized by the various signals applied to grids 58.

As has been pointed out above, the drift space may be located either between the cathode and the first (extraction) grid or between the first grid and the second (modulation) grid. Accordingly, for some applications of the latter alternative, the drift space may be incorporated into the structure of FIG. 7 by causing the thickness of spacer 54 to be one inch or so as to place the drift space between grids 52 and 58 with a corresponding reduction in thickness of spacer 48.

It is clear that the "drift space" concept taught herein may be usefully employed in display devices other than that shown in FIG. 7 to reduce the required amplitude of the control signals and to provide improved contrast ratio. Moreover, the drift space concept may be used in many other forms of gas discharge devices where an electron beam is extracted from a gas discharge and accelerated toward a target anode. Where the "drift space" is so used, it will permit the use of modulating signals which have a much lower amplitude than that of signals used in gas discharge devices not having drift spaces. Accordingly, this invention is intended to embrace all such applications of the "drift space" which fall within the spirit and scope of the appended claims.

I claim:

1. For use in a gas discharge system in which electrons are extracted from a gas discharge and accelerated toward a designated target anode, the combination comprising, in the following sequential ordered arrangement:

means including a cathode electrode for generating a gas discharge for use as a source of electrons;

an electron-transmissive extraction grid electrode spaced from said cathode electrode and receiving an electrical potential for extracting electrons from the gas discharge;

an electron-transmissive modulation grid electrode spaced from and aligned with said extraction grid electrode and adapted to receive a control voltage for modulating the flow of electrons through itself, the spacing between the extraction grid electrode and one of said other electrodes being selected such that a drift space having a length approximately equivalent to at least one ionization mean free path is located between said extraction grid and said one other electrode, said drift space acting to lower the energy of the electrons arriving at said modulation grid electrode so that the flow of electrons therethrough can be modulated by a smaller amplitude control voltage than is possible without the drift space; and a target anode spaced from said modulation grid and receiving an accelerating potential for accelerating toward itself those electrons which pass through the modulation grid electrode, the spacing between the target anode and the modulation grid electrode being too small, at the gas pressure within the system, to sustain a gas discharge therebetween.

2. The combination as set forth in claim 1 wherein said cathode electrode and said extraction grid electrode are spaced apart by a distance substantially equal to said drift space.

3. The combination as set forth in claim 1 wherein said extraction grid electrode and said modulation grid electrode are spaced apart by a distance substantially equal to said drift space.

4. For use in a gas discharge system in which electrons are extracted from a gas discharge and accelerated toward a designated target, the combination comprising, in the following order:

means including a cathode for generating a gas discharge for use as a source of electrons;

an extraction grid spaced from the cathode by a drift space having a length approximately equivalent to at least one ionization mean free path for extracting electrons from the discharge;

a modulation grid spaced from and aligned with the extraction grid for modulating the flow of electrons past said modulation grid, said drift space acting to lower the energy of electrons arriving at said modulation grid so that the flow of electrons can be modulated by a smaller amplitude control voltage than is possible without the drift space; and a target anode spaced from said modulation grid and receiving an accelerating potential for accelerating toward itself those electrons which pass the modulation grid, the spacing between the target anode and the modulation grid and between the extraction grid and the modulation grid being too small, at the gas pressure within the system, to sustain a gas discharge therebetween.

5. For use in a gas discharge system operated at a pressure P in which electrons are extracted from a gas discharge and accelerated toward a designated target, the combination comprising, in the following order:

means including a cathode for generating a gas discharge for use as a source of electrons;

an extraction grid spaced from the cathode by a drift space having a length $d$ such that the product $P \times d$ in the drift space is equivalent to at least approximately 1.0 torr-centimeter of Helium, and adapted to receive an electrical potential for extracting electrons from the discharge;

a modulation grid spaced from said extraction grid and adapted to receive a control voltage for modulating the flow of electrons through said modulation grid, said drift space acting to lower the energy of electrons arriving at said modulation grid electrode so that the flow of electrons therethrough can be modulated by a smaller amplitude control voltage than is possible without the drift space; and a target anode spaced from said modulation grid and adapted to receive an accelerating potential for accelerating toward itself those electrons which pass through the modulation grid, the spacing between the target anode and the modulation grid being too small, at the gas pressure within the system, to sustain a gas discharge therebetween.

6. For use in a gas discharge system operated at a pressure P in which electrons are extracted from a gas discharge and accelerated toward a designated target, the combination comprising, in the following order:

means including a cathode for generating a gas discharge for use as a source of electrons;

an extraction grid spaced from the cathode and adapted to receive an electrical potential for extracting electrons from the discharge;

a modulation grid adapted to receive a control voltage for modulating the flow of electrons and spaced from said extraction grid by a drift space having a length d such that the product Pxd in the drift space is equivalent to at least approximately 1.0; torr-centimeter of Helium, said drift space acting to lower the energy of electrons arriving at said modulation grid electrode so that the flow of electrons therethrough can be modulated by a smaller amplitude control voltage than is possible without the drift space; and a target anode spaced from said modulation grid and adapted tp receive an accelerating potential for accelerating toward itself those electrons which pass through the modulation grid, the spacing between the target anode and the modulation grid being too small, at the gas pressure within the system, to sutain a gas discharge therebetween.

7. For use in a gas discharge system in which electrons are extracted from a gas discharge and accelerated toward a designated target, the combination comprising, in the following order:

means including a cathode for generating a gas discharge for use as a source of electrons;

an electron-transmissive extraction grid spaced from the cathode and adapted to receive an electrical potential for extracting the electrons from the discharge, the gas pressure of the system and the spacing between the cathode and the extraction grid being selected such that a positive column effect is generated between the cathode and the extraction grid to thereby reduce the energy of the electrons extracted from the discharge and to permit easier modulation of the extracted electrons;

an electron-transmissive modulation grid spaced from and aligned with the extraction grid for modulating the flow of electrons through the modulation grid; and a target anode spaced from said modulation grid and adapted to receive an accelerating potential for accelerating toward itself those electrons which pass through the modulation grid, the spacing between the target anode and the modulation grid being too small, at the gas pressure within the system, to sustain a gas discharge therebetween.

8. For use in a gas discharge system in which electrons are extracted from a gas discharge and accelerated toward a designated target, the combination comprising, in the following order:

means including a cathode for generating a gas discharge for use as a source of electrons;

an electron-transmissive extraction grid spaced from the cathode and adapted to receive an electrical potential for extracting electrons from the discharge;

an electron-transmissive modulation grid spaced from and aligned with the extraction grid for modulating the flow of electrons through the modulation grid, the gas pressure of the system and the spacing between the modulation grid and the extraction grid being selected such that a positive column effect is generated between the modulation grid and the extraction grid to thereby reduce the energy of the electrons arriving at the modulation grid and to permit easier modulation of those arriving electrons; and a target anode spaced from said modulation grid and adapted to receive an accelerating potential for accelerating toward itself those electrons which pass through the modulation grid, the spacing between the target anode and the modulation grid being too small, at the gas pressure within the system, to sustain a gas discharge therebetween.

9. For use in a low pressure gas discharge panel within the rear of which gas discharges are generated for use as sources of electrons with which to bombard and excite light-emitting phosphor targets near the front of the panel, the combination comprising;

means including a cathode electrode located near the rear of the panel for generating a discharge for use as an electron source;

a first electron-transmissive grid electrode situated forward of said cathode electrode and adapted to receive a first energizing potential for extracting electrons from the discharge;

a second electron-transmissive grid electrode situated forward of said first grid means and adapted to receive a second energizing potential for controlling the flow of electrons through said first and second grid electrodes, the spacing between said first grid electrode and one of said other electrodes being selected such that a drift space having a length equivalent to at least one ionization mean free path is located between said first electrode grid and said one other electrode, said drift space acting to lower the energy of electrons at said second grid electrode so that the flow of electrons therethrough can be controlled by a smaller amplitude energizing potential than is possible without the drift space; and a faceplate near the front of the panel having a phosphor coating thereon which emits light when struck by electrons said, faceplate adapted to receive a third energizing potential for accelerating toward the phosphor coating those electrons which pass through said second grid means, the faceplate and the second grid means being spaced apart by a distance which is too small to sustain a gas discharge at the gas pressure which exists in the panel.

10. The combination as set forth in claim 9 wherein said cathode electrode and said first grid electrode are spaced apart by a distance substantially equal to said drift space.

11. The combination as set forth in claim 9 wherein said first grid electrode and said second grid electrode are spaced apart by a distance substantially equal to said drift space.

* * * * *